US005838801A

United States Patent [19]

Ishige et al.

[11] Patent Number: 5,838,801

[45] Date of Patent: Nov. 17, 1998

[54] DIGITAL HEARING AID

[75] Inventors: Ryuuichi Ishige; Yukio Mitome, both of Tokyo, Japan

[73] Assignee: Nec Corporation, Tokyo, Japan

[21] Appl. No.: 987,617

[22] Filed: Dec. 9, 1997

[30] Foreign Application Priority Data

Dec. 10, 1996 [JP] Japan ..... 8-329354

[51] Int. Cl.[6] ..... H04R 25/00

[52] U.S. Cl. ..... 381/68.4; 381/68

[58] Field of Search ..... 381/68, 68.4, 68.2, 381/60, 58; 128/746

[56] References Cited

U.S. PATENT DOCUMENTS 4,419,544 12/1983 Adelman ..... 381/68.4

FOREIGN PATENT DOCUMENTS 03-284000 12/1991 Japan .

*Primary Examiner*—Minsun Oh Harvey
*Attorney, Agent, or Firm*—Foley & Lardner

[57] ABSTRACT

A digital hearing aid has input means for converting an input sound into a digital data for generating an input data, analyzing means for analyzing the input data converted by the input means by a digital conversion and calculating an acoustic pressure at each frequency band, control means for inputting a result of calculation by the analyzing means, acoustic sense characteristics storage means for preliminarily storing acoustic sense characteristics of a deafness and a person having healthy acoustic sense from a fitting means, gain calculation data storage means for preliminarily storing an acoustic pressure range the easiest to hear for the deafness from the fitting means, and acoustic sense compensating means for performing acoustic sense compensation process by amplifying the input data with a given gain. The control means calculates the gain of each frequency range on the basis of the acoustic sense characteristics and an acoustic pressure range stored in the acoustic sense characteristics storage means and the gain calculation data storage means.

8 Claims, 17 Drawing Sheets

DIGITAL HEARING AID

BACKGROUND OF THE INVENTION

1. Field of the Invention

The present invention relates a digital hearing aid or hearing aid for sensorineural deafness using a digital signal processing.

2. Description of the Related Art

A hearing impairment, i.e. deafness, is generally classified into two kinds, i.e. conductive deafness and sensorineural deafness.

The conductive deafness is a hearing impairment caused for variation of transmission characteristics due to failure of any one or all of external ear, middle ear. This type of hearing impairment can be simply overcome by amplifying input sound.

On the other hand, the sensorineural deafness is a hearing impairment which is considered to be caused by organic failure in a certain portion from internal ear to cortical auditory area, and represents a condition causing difficulty in perceiving sound for abnormality of internal ear or so forth. Such difficulty of perceiving sound can be caused by dropout of stereocilium at the tip end of hair cell of cochlea or by failure of nerve transmitting voice. Also, presbyacusis is involved in this type of deafness. The sensorineural deafness is difficult to overcome by the conventional hearing aids which simply amplify sounds. In the recent years, attention has been attracted to digital hearing aid which can perform complicate signal processing. There is significant difference of symptom of sensorineural deafness in each individual. One of primary symptom of sensorineural deafness is recruitment of loudness.

This is the phenomenon to rise a minimum level (Hearing Threshold Level: HTL) and to maintain a maximum level (Uncomfortable Level: UCL) as substantially unchanged to narrow audible range (audible area), as shown in FIG. 13. Also, the uncomfortable level is frequently lowered slightly. Namely, this is the phenomenon to cause difficulty in hearing a low level sound but to hear a high level sound in substantially equal level to a person having normal hearing ability. If the sound is amplified by the hearing aid for making the low level sound to hear, the output sound of the hearing aid upon inputting of high level sound should exceed the uncomfortable level to be uncomfortable level to perceive.

For this reason, it becomes necessary to amplify low level sound with a high amplification, and to amplify high level sound with a low amplification. It is also one characteristics of sensorineural deafness in variation of the hearing acuity per frequency level.

As measures for the sensorineural deafness, there can be exemplified two measures. The first measure has been disclosed in Japanese Unexamined Patent Publication (Kokai) No. Heisei 3-284000, in which a dynamic range of an input sound is compressed into a audible range of deafness.

FIGS. 14(*a*) to 14(*e*) show an acoustic sense compensation method of a hearing aid employing a method disclosed in the above-identified publication.

FIG. 14(*a*) is a graph taking an acoustic pressure on the horizontal axis and a loudness on the vertical axis. Acoustic pressure is a physical amount of sound and loudness is a magnitude to be felt by a listener as hearing a sound of certain acoustic pressure, namely sensory amount. In the graph, a solid line represents a relationship between the acoustic pressure and the loudness as heard by a person having healthy or normal acoustic sense, and a broken line represents a relationship between the acoustic pressure and the loudness as heard by a person having deafness.

As can be appreciated from FIG. 14(*a*), a sound having a given level of acoustic pressure is heard by people one having healthy acoustic sense and the other having deafness, the person having healthy acoustic sense feels greater magnitude of sound than the person having deafness. When the acoustic pressure to be heard becomes lower than the hearing threshold level, while the person having healthy acoustic sense can hear the sound, the person having deafness cannot hear.

FIG. 14(*b*) shows the acoustic pressure feeling equal loudness level in the person having healthy acoustic sense and the person having deafness. In FIG. 14(*b*), the vertical axis and the horizontal axis respectively represent acoustic pressure level for the person having deafness and acoustic pressure level for the person having healthy acoustic sense. Difference of the sound to be felt at equal level by the person having deafness and the person having healthy acoustic sense increases according to decreasing of the acoustic pressure and decreases according to increasing of the acoustic pressure. In FIG. 14(*b*), the broken line represents the result of comparison of the acoustic pressure level to be heard at equal loudness level between people having healthy acoustic sense. As can be seen, in this case, increasing of the acoustic pressure becomes linear. In FIG. 14(*b*), considering that the acoustic pressure level for the person having healthy acoustic sense is input and the acoustic pressure level for the person having deafness is output, by amplifying an input sound by the hearing aid with taking a difference between the broken line and the slid line in FIG. 14(*c*) as an amplification, the person having deafness may feel the equal magnitude of the sound as that felt by the person having healthy acoustic sense.

FIG. 14(*d*) shows a relationship between amplification to be calculated as set forth above, and an input acoustic pressure. As can be seen, when the input acoustic pressure is lower, the amplification becomes greater, and when the input acoustic pressure is higher, the amplification becomes smaller.

FIG. 14(*e*) is a conceptual illustration of a method for calculating an amplification of the hearing aid on the basis of the loudness curves of the person having healthy acoustic sense and the person having deafness and magnitude of input sound. In FIG. 14(*e*), the vertical axis represents the loudness level (phon) and the horizontal axis represents the acoustic pressure level (dB) of the input sound. The solid line is a loudness curve of the person having healthy acoustic sense and one-dotted line is a loudness curve of the person having deafness (hereinafter occasionally referred to as "user of hearing aid" or simply as "user"). FIG. 14(*e*) illustrates the magnitude of sound to be heard by the person having healthy acoustic sense and the user of the hearing aid. For example, the sound heard at a level c' by the person having healthy acoustic sense has the acoustic pressure of c, whereas the sound heard at the level c' by the person having deafness has the acoustic pressure of c". Namely, when the sound having the acoustic pressure of c is amplified to have the acoustic pressure of c" to make the person having deafness to hear, the person having deafness may hear the sound in substantially equal level as that heard by the person having healthy acoustic sense. That is, the amplification of the hearing application is that necessary for amplifying the acoustic pressure of c to the acoustic pressure c".

In FIG. 14(*e*), both of the vertical axis and the horizontal axis represent logarithmic values. Therefore, the amplification can be calculated from the following equation (1).

$$G=c''-c \quad (1)$$

wherein G is an amplification, c" is the magnitude of sound to be heard by the person having deafness and c is the magnitude of the input sound.

As can be appreciated from the foregoing equation, the amplification becomes greater at greater difference of c" and c.

On the other hand, the second prior art has been disclosed in Japanese Unexamined Patent Publication No. Heisei 2-192300. In the disclosed prior art, an input signal is converted into a signal which can be controlled by a digital process, by a pulse density modulation, and a gain is controlled by varying a pulse density of the pulse density modulated input signal.

The input sound is input through a microphone 201 and a pre-amplifier 203 and modulated into the pulse density modulated signal which is adapted to a digital control, by a pulse density modulation circuit 204. The pulse density modulation signal is provided a gain by a digital gain varying circuit 205. Also, when the pulse density is excessively large, the pulse density is adjusted by an output restriction circuit 206. In the output restriction circuit 206, a pulse density preliminarily set by a maximum output setting terminal and the pulse density of the input signal are compared to perform control. By means of the digital gain varying circuit 205 and the output restriction circuit 206, the pulse density modulated signal which is amplified and output restricted, is demodulated into an analog signal by a demodulation circuit 207 and output through a power amplifier 208 and a receiver 209.

On the other hand, the pulse density modulated signal, to which the gain is provided, is input to a pulse density detection circuit 210, and an information indicative of the pulse density is transferred to a digital control circuit 211. In the digital control circuit 211, the gain with respect to the input signal is calculated on the basis of the pulse density and two set values to control the digital gain varying circuit 205 and the output restriction circuit 206.

Calculation of the gain of the digital control circuit 211 is performed by comparing the pulse density preliminarily set by a gain control starting output setting terminal and the pulse density if the input signal, for gradually decreasing the gain when the pulse density of the input signal exceeds the set value, gradually increasing the gain when the pulse density of the input signal is less than the set value, and for gradually returning to the preliminary set value by the gain setting terminal when the pulse density of the input signal is consistent with the set value.

In case of the first prior art, the gain for the input sound becomes greater at smaller acoustic pressure. As a result, environmental fine noise which should not be heard actually, is amplified by significantly large gain. Therefore, the input sound which is processed by an acoustic sense compensation process contains noise amplified by significantly large gain in an anacoustic portion to cause a difficulty for a listener to hear subsequent voice due to masking in time direction.

In case of the second prior art, consideration is not given for characteristics of acoustic sense of deafness significantly different in respective frequency bands. Also, gain cannot be set individually for respective frequency bands. As a result, for the deafness having different acoustic sense per respective frequency bands, the gain in the frequency band, at which the deafness has a difficult to hear, is small and, the gain in the frequency band, at which the deafness can hear easily, is too large. As a result, it is possible to cause a difficulty of hearing.

SUMMARY OF THE INVENTION

Therefore, it is an object of the present invention to provide a digital hearing aid which can output a voice easy to hear for a user.

According to the first aspect of the present invention, a digital hearing aid comprises:

- input means for converting an input sound into a digital data for generating an input data;
- analyzing means for analyzing the input data converted by the input means by a digital conversion and calculating an acoustic pressure at each frequency band;
- control means for inputting a result of calculation by the analyzing means;
- acoustic sense characteristics storage means for preliminarily storing acoustic sense characteristics of a deafness and a person having healthy acoustic sense from a fitting means;
- gain calculation data storage means for preliminarily storing an acoustic pressure range the easiest to hear for the deafness from the fitting means;
- acoustic sense compensating means for performing acoustic sense compensation process by amplifying the input data with a given gain;
- the control means calculating the gain of each frequency range on the basis of the acoustic sense characteristics and an acoustic pressure range stored in the acoustic sense characteristics storage means and the gain calculation data storage means.

In a second aspect of the present invention, the digital hearing aid may further comprise minimum acoustic pressure storage means for preliminarily storing a minimum acoustic pressure level from a fitting device, and the control means disables the acoustic sense compensating means to output the input data when the result of the analyzing means is lower than the minimum acoustic pressure level stored in the minimum acoustic pressure storage means.

In a third aspect of the present invention, the digital hearing aid may further comprise minimum acoustic pressure setting means for setting a minimum acoustic pressure by a user, and minimum acoustic pressure storage means for storing the set minimum acoustic pressure level, and the control means disables the acoustic sense compensating means to output the input data when the result of the analyzing means is lower than the minimum acoustic pressure level stored in the minimum acoustic pressure storage means.

In a fourth aspect of the present invention, the digital hearing aid may further comprise maximum acoustic pressure storage means for preliminarily storing a maximum acoustic pressure level from a fitting device, and the control means disables the acoustic sense compensating means to output the input data when the result of the analyzing means is higher than the maximum acoustic pressure level stored in the maximum acoustic pressure storage means.

In a fifth aspect of the present invention, the digital hearing aid may further comprise maximum acoustic pressure setting means for setting a maximum acoustic pressure by a user, and maximum acoustic pressure storage means for storing the set maximum acoustic pressure level, and the control means disables the acoustic sense compensating means to output the input data when the result of the analyzing means is higher than the maximum acoustic pressure level stored in the maximum acoustic pressure storage means.

In a sixth aspect of the present invention, the digital hearing aid may further comprise minimum acoustic pressure storage means for preliminarily storing a minimum acoustic pressure level and maximum acoustic pressure storage means for preliminarily storing a maximum acoustic pressure level from a fitting device, and the control means disables the acoustic sense compensating means to output the input data when the result of the analyzing means is lower than the minimum acoustic pressure level stored in the minimum acoustic pressure storage means or when the result of the analyzing means is higher than the maximum acoustic pressure level stored in the maximum acoustic pressure storage means.

In a seventh aspect of the present invention, the digital hearing aid may further comprise minimum acoustic pressure setting means for setting a minimum acoustic pressure and maximum acoustic pressure setting means for setting a maximum acoustic pressure by a user, and minimum acoustic pressure storage means for storing the set minimum acoustic pressure level, and maximum acoustic pressure storage means for preliminarily storing a maximum acoustic pressure level from a fitting device, and the control means disables the acoustic sense compensating means to output the input data when the result of the analyzing means is lower than the minimum acoustic pressure level stored in the minimum acoustic pressure storage means or when the result of the analyzing means is higher than the maximum acoustic pressure level stored in the maximum acoustic pressure storage means.

In an eighth aspect of the present invention, the fitting device may calculate the acoustic pressure range the easiest to hear for the deafness on the basis of the result of articulation score test.

BRIEF DESCRIPTION OF THE DRAWINGS

The present invention will be understood more fully from the detailed description given hereinbelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscure the present invention.

Figure 1:
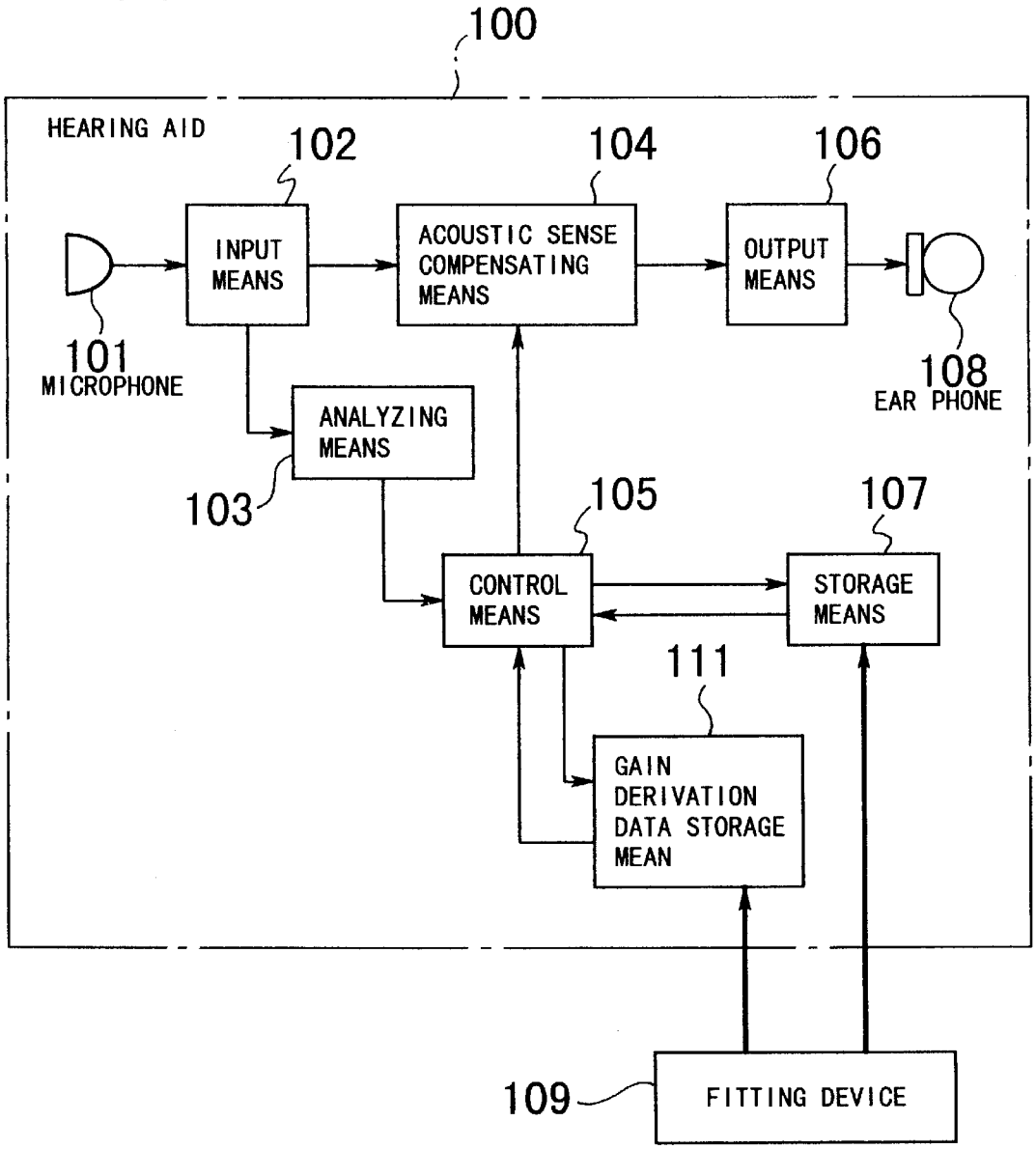
FIG. 1 is a block diagram showing the first embodiment of a digital hearing aid according to the present invention.

FIG. 1 shows the first embodiment of a digital hearing aid according to the present invention. At first, a basic operation of the first embodiment of the digital hearing aid will be explained with reference to FIG. 1.

The digital hearing aid according to the present invention is directed to a user having a sensorineural deafness Therefore, an acoustic sense compensation process has to compress a dynamic range of an input sound into an acoustic field of user (deafness) having narrower acoustic field than that of a person having healthy acoustic sense by amplifying a small amplitude of the input sound with a large gain and a large amplitude of the input sound with a small gain. Hereinafter, this compression process will be referred to as a hearing aiding process.

On the other hand, a variation characteristics of gain employed in the acoustic sense compensation process is differentiated at respective frequency band s similarly to characteristics of acoustic sense of the user, and has to be determined depending upon the characteristics of acoustic sense of the user. For calculating the gain with respect to the input signal in this method, comparison of loudness curves of the deafness and the person having a healthy acoustic sense is performed conventionally.

However, measurement of the loudness curve requires substantially large number of steps, significant load can be caused on a tester. Therefore, it is one of features of the present invention to calculate the gain for the input sound from the result of articulation score without using the loudness curve.

In the present invention, the input sound picked up through a microphone 101 is converted into a digital data. The resultant digital data is analyzed to calculate acoustic pressures at respective frequency bands. Then, gain of the digital data is calculated on the basis of an acoustic pressure range, the best heard by a deafness, which acoustic pressure range is calculated from an acoustic sense data and result of articulation score of the deafness, and a result of analysis of the digital data.

Then, the hearing aiding process is performed for the digital data using the gain thus calculated. The digital data thus processed is again converted into an analog data to be output as hearing aiding processed sound.

In the first embodiment of the present invention, a hearing aid includes a microphone 101, an input means 102, an analyzing means 103, an acoustic sense compensating means 104, a control means 105, an output means 106, a storage means 107, a ear phone 108 and a storage means 111 for gain calculation.

Figure 3:
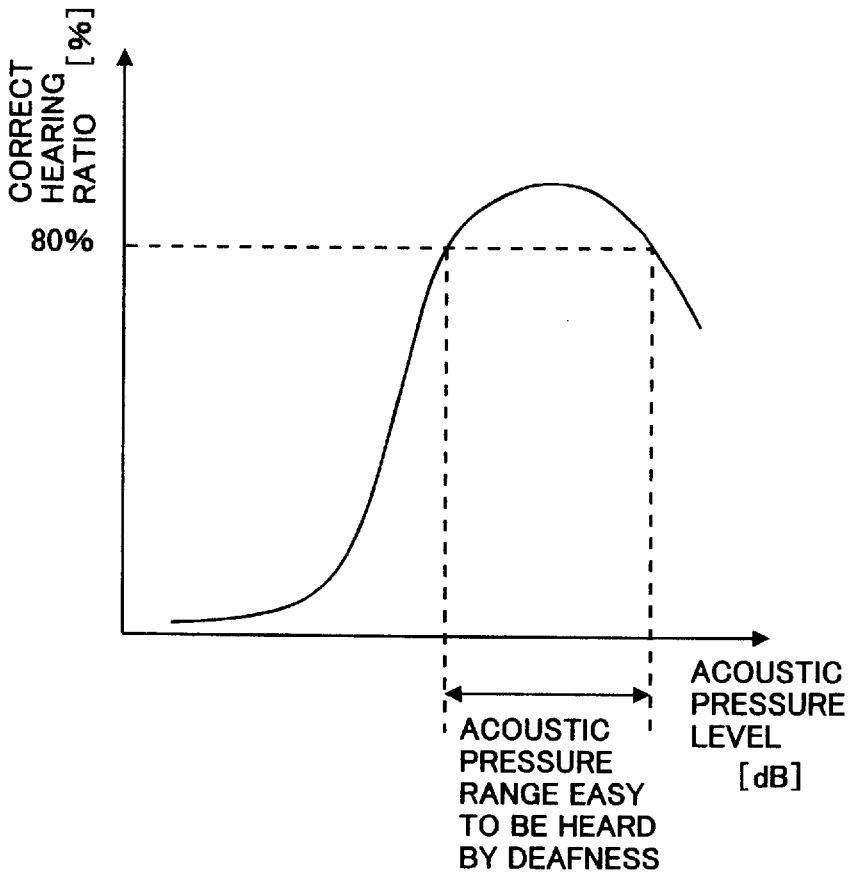
FIG. 3 is a graph for explaining a setting method an acoustic pressure range which is the easiest to hear for a user.

In the hearing aid 100, characteristics of acoustic sense of the user (deafness) and a person having health acoustic sense is preliminarily stored in the storage means 107 by an external fitting device 109. Also, an acoustic pressure range the best heard by the user, is stored in the storage means 111 for gain calculation. An acoustic sense data stored in the storage means 107 are HTLs of the person having healthy acoustic sense and the deafness. The acoustic pressure range the easiest to hear for the user, is preferably calculated per each frequency band, by frequency analysis of a plurality of test sounds obtainable of high correct hearing ratio in the articulation score test, as shown in FIG. 3. In the storage means 111 for gain calculation, the acoustic pressure range thus calculated in the fitting device 109 is stored, It should be noted that, upon fitting, the acoustic pressure levels the easiest to hear for the user at respective frequency bands, required for setting, may be checked.

The input sound picked up by the microphone 101 is converted into the digital data (hereinafter referred to as input data) by the input means 102. The input data is buffered by the input means 102, if necessary, and is fed to the analyzing means 103 and the acoustic sense compensating means 104. In the analyzing means 103, the input data is analyzed by FFT (Fast Fourier Transform) or so forth, and the acoustic pressure at each frequency band is calculated (hereinafter referred to as analysis result). The analysis result is fed to the control means 105. The control means 105 determines a gain per respective frequency band required in the acoustic sense compensating means on the basis of the acoustic sense characteristics and the acoustic pressure range stored in the storage means 107 and 111 and the analysis result by the analyzing means 103, and feeds a gain data to the acoustic sense compensating means 104. The acoustic sense compensating means 104 thus obtained the input data and the gain data, performs acoustic sense compensating process for the input data according to the gain data. A processed input data is fed to the output means 106. In the output means 106, the input data processed by the acoustic sense compensating means 104 is converted into the analog data to be output as acoustic sense compensation processed sound by the ear phone 108.

Figure 2:
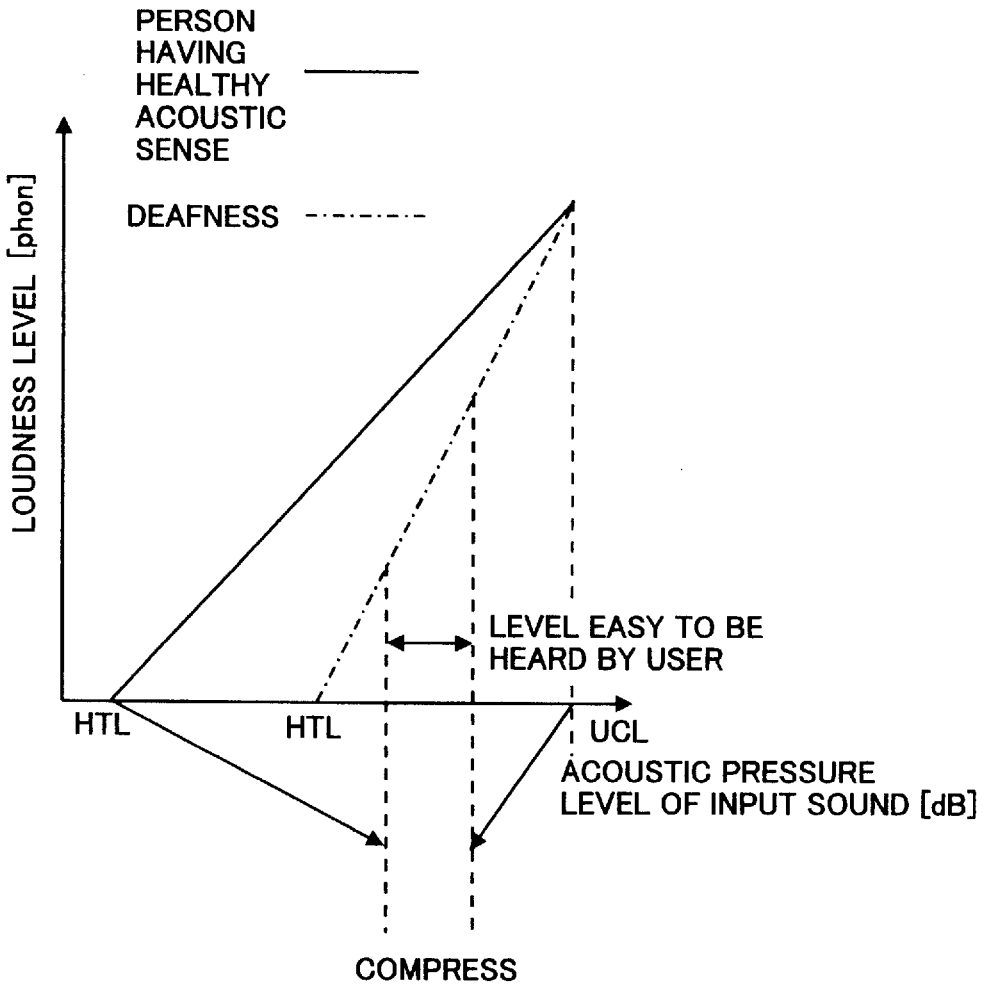
FIG. 2 is a graph showing a loudness curve of the first embodiment of the digital hearing aid according to the invention.

As shown in FIG. 2, the output sound becomes a sound generated by compressing the dynamic range of the input sound. FIG. 2 is a graph, in which UCL and HTL of the person having healthy acoustic sense and the deafness are connected by straight lines assuming that the loudness is increased in proportion to the acoustic pressure, with taking the loudness [phone] on the vertical axis and the acoustic pressure level [dB] on the horizontal axis, and represents that the dynamic range of the input sound of between the HTL and the UCL of the person having healthy acoustic sense into the acoustic pressure range the easiest to hear for the deafness.

Figure 4:
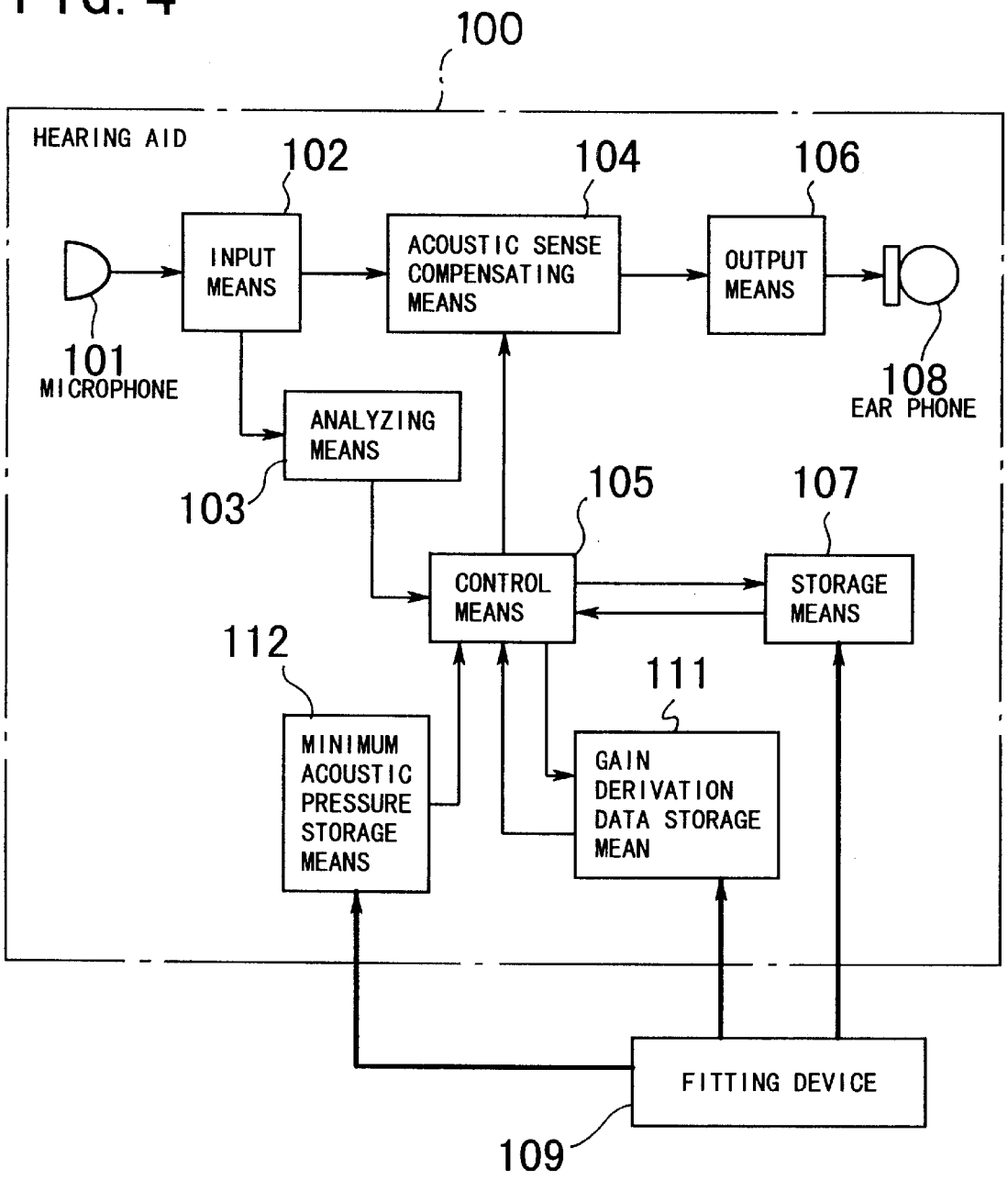
FIG. 4 is a block diagram of the second embodiment of the digital hearing aid according to the present invention.

FIG. 4 shows the second embodiment of the digital hearing aid according to the present invention. In the second embodiment, in addition to the first embodiment of the digital hearing aid according to the invention, a minimum acoustic pressure storage means 112 storing a minimum acoustic pressure level for restricting output in the hearing aid 100, is provided, so that the input sound lower than the minimum acoustic pressure S is not output.

Namely, in FIG. 4, the minimum acoustic pressure for restricting output in the hearing aid 100 is preliminarily written in the minimum acoustic pressure storage means 112 from the fitting device 109. The control means reads out the data of the acoustic pressure range the easiest for the user, stored in the storage means 107, and, in conjunction therewith, reads out the minimum acoustic pressure level stored in the minimum acoustic pressure storage means 112. When the result of calculation of the analyzing means 103 is lower than the minimum acoustic pressure level stored in the minimum acoustic pressure storage means 112, the control means 105 disables outputting of the input data from the acoustic sense compensating means 104.

Figure 5:
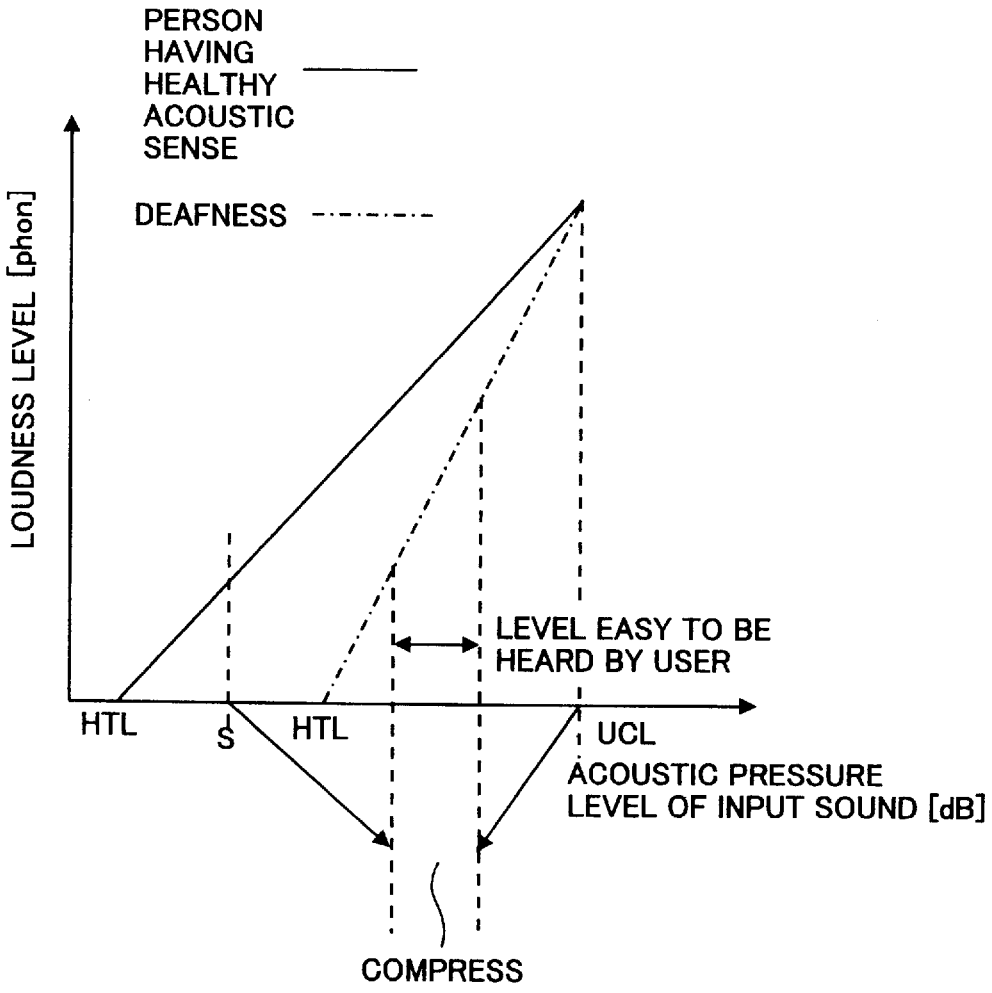
FIG. 5 is a graph showing a loudness curve of the second embodiment of the digital hearing aid according to the invention.

On the other hand, the analysis result is higher than or equal to the minimum acoustic pressure level, the input data is processed by hearing aid process by the acoustic pressure compensating means 104 using the gain calculated from the data of the acoustic pressure range the easiest for the deafness. As a result, the dynamic range of the input sound becomes a range between the set minimum acoustic pressure S and the UCL, as shown in FIG. 5 so that the input sound of the acoustic pressure level lower than the set minimum acoustic pressure S is not output from the hearing aid 100.

Figure 6:
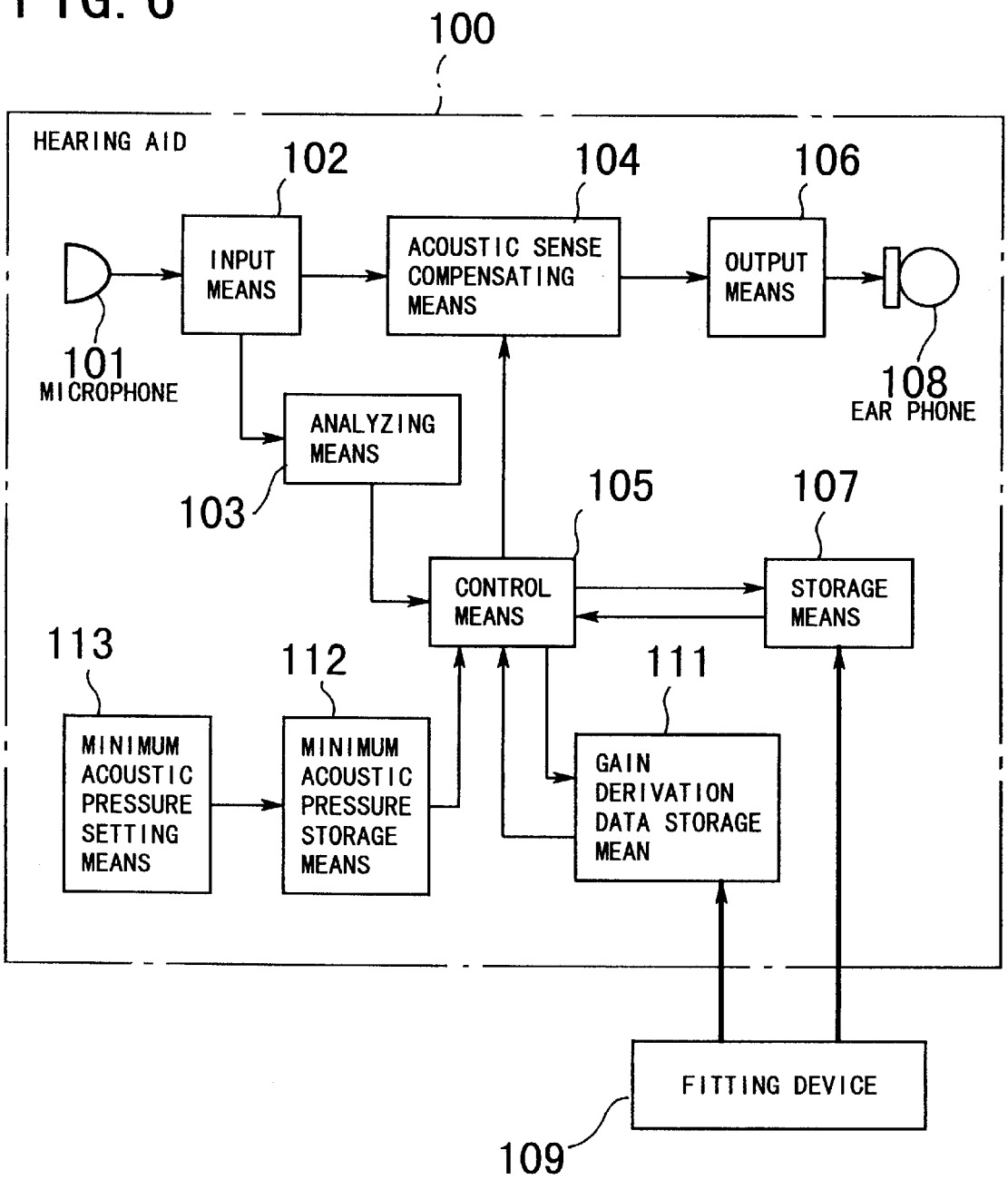
FIG. 6 is a block diagram of the third embodiment of the digital hearing aid according to the present invention.

FIG. 6 shows the third embodiment of the hearing aid according to the present invention. In the third embodiment, the minimum acoustic pressure storage means 112 is not set the minimum acoustic pressure level from the fitting device 109, and instead, is set the minimum acoustic pressure level by the user through a minimum acoustic pressure setting means (volume controller or so forth) 113.

Figure 7:
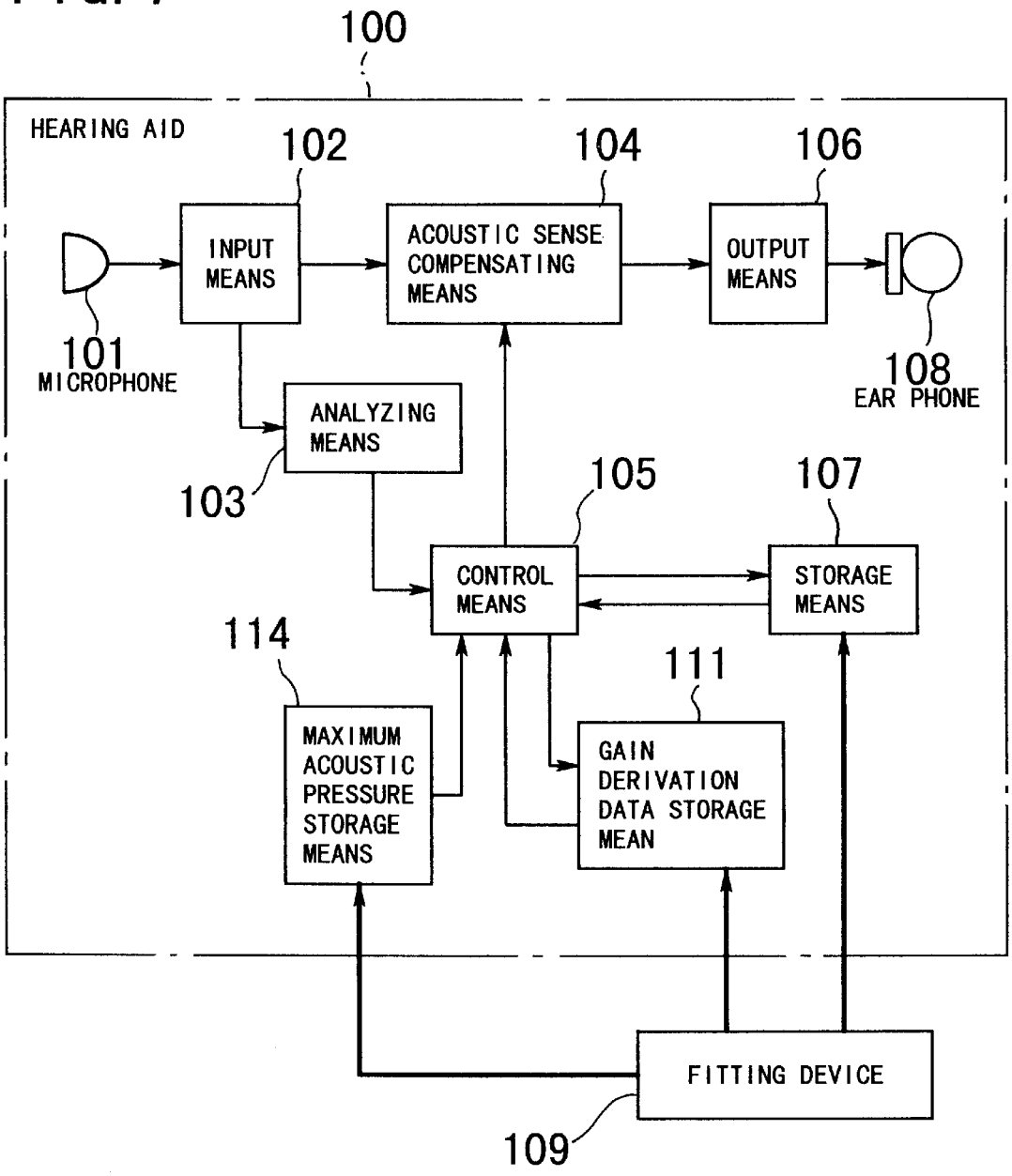
FIG. 7 is a block diagram of the fourth embodiment of the digital hearing aid according to the present invention.

FIG. 7 shows the fourth embodiment of the hearing aid according to the present invention. In the fourth embodiment, in addition to the first embodiment, a maximum acoustic pressure storage means 114 storing the maximum acoustic pressure level for restricting output in the hearing aid 100, is provided. Thus, the input sound having acoustic pressure higher than the preliminarily set the maximum acoustic pressure L is not output.

Namely, in FIG. 7, the maximum acoustic pressure level for restricting output in the hearing aid 100 is preliminarily stored in the maximum acoustic pressure storage means 114 from the fitting device 109. The control means reads out the data of the acoustic pressure range the easiest for the user, stored in the storage means 107, and, in conjunction therewith, reads out the maximum acoustic pressure level stored in the maximum acoustic pressure storage means 114. When the result of calculation of the analyzing means 103 is higher than the maximum acoustic pressure level stored in the maximum acoustic pressure storage means 114, the control means 105 disables outputting of the input data from the acoustic sense compensating means 104.

Figure 8:
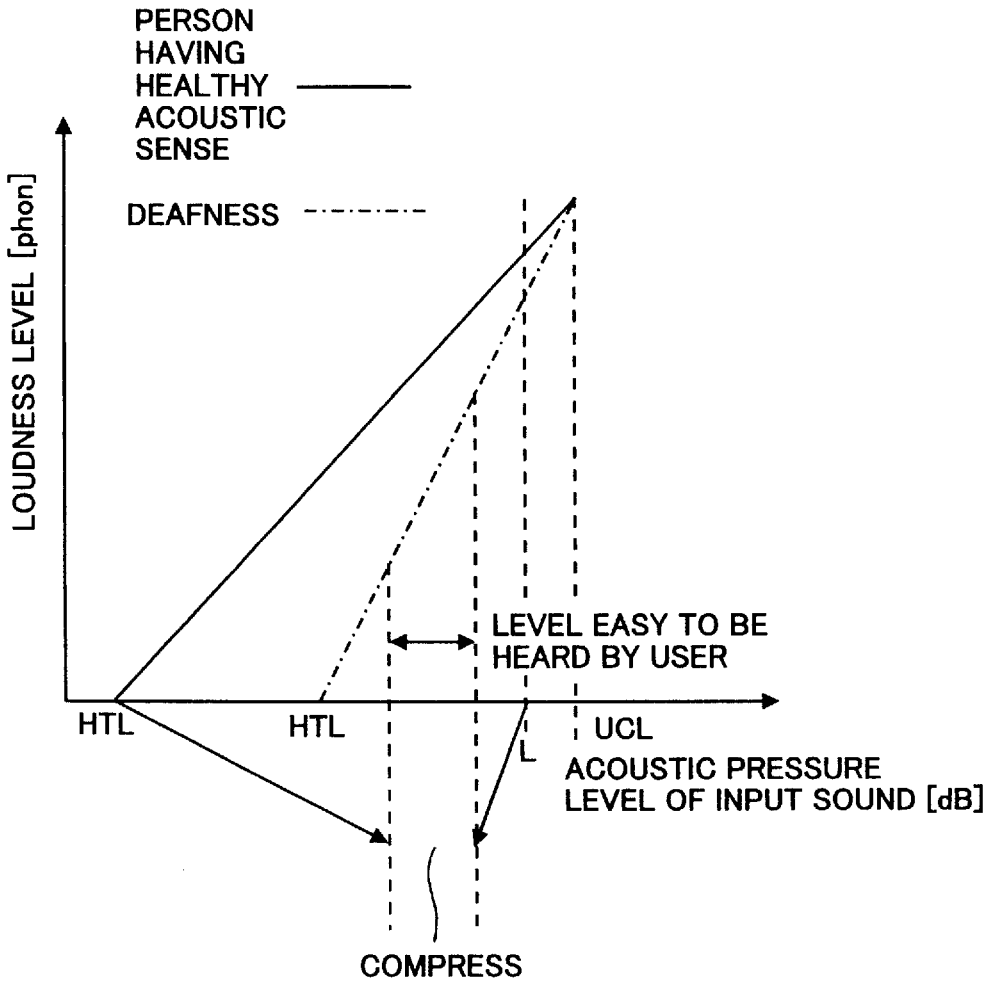
FIG. 8 is a graph showing a loudness curve of the fourth embodiment of the digital hearing aid according to the invention.

On the other hand, the analysis result is lower than or equal to the maximum acoustic pressure level, the input data is processed by hearing aid process by the acoustic pressure compensating means 104 using the gain calculated from the data of the acoustic pressure range the easiest for the deafness. As a result, the dynamic range of the input sound becomes a range between the HTL and the set maximum acoustic pressure L, as shown in FIG. 8 so that greater sound greater than is not output from the hearing aid 100.

Figure 9:
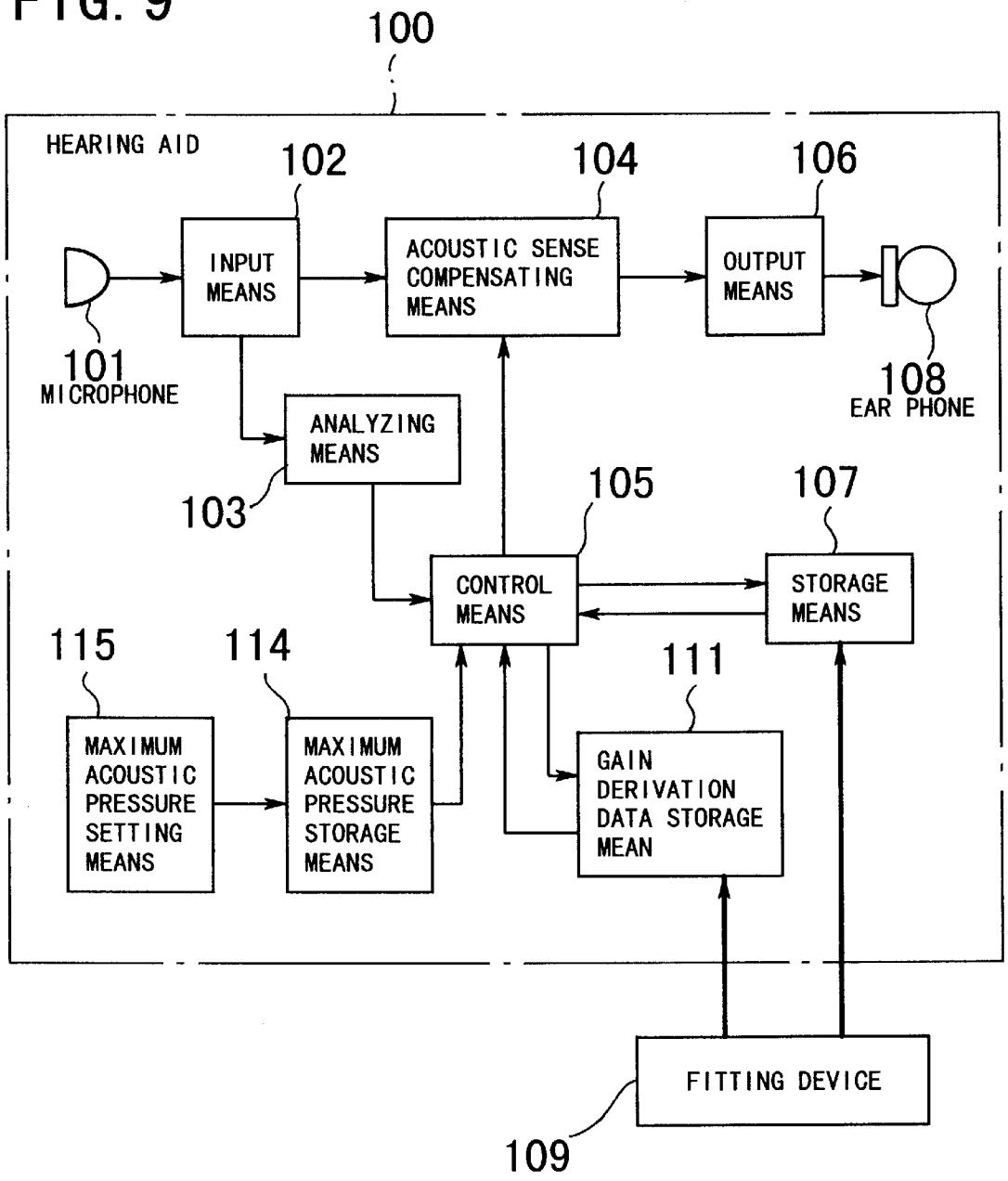
FIG. 9 is a block diagram of the fifth embodiment of the digital hearing aid according to the present invention.

FIG. 9 shows the fifth embodiment of the hearing aid according to the present invention. In the fifth embodiment, the maximum acoustic pressure storage means 114 is not set the maximum acoustic pressure level from the fitting device 109, and instead, is set the maximum acoustic pressure level by the user through a maximum acoustic pressure setting means 115.

Figure 10:
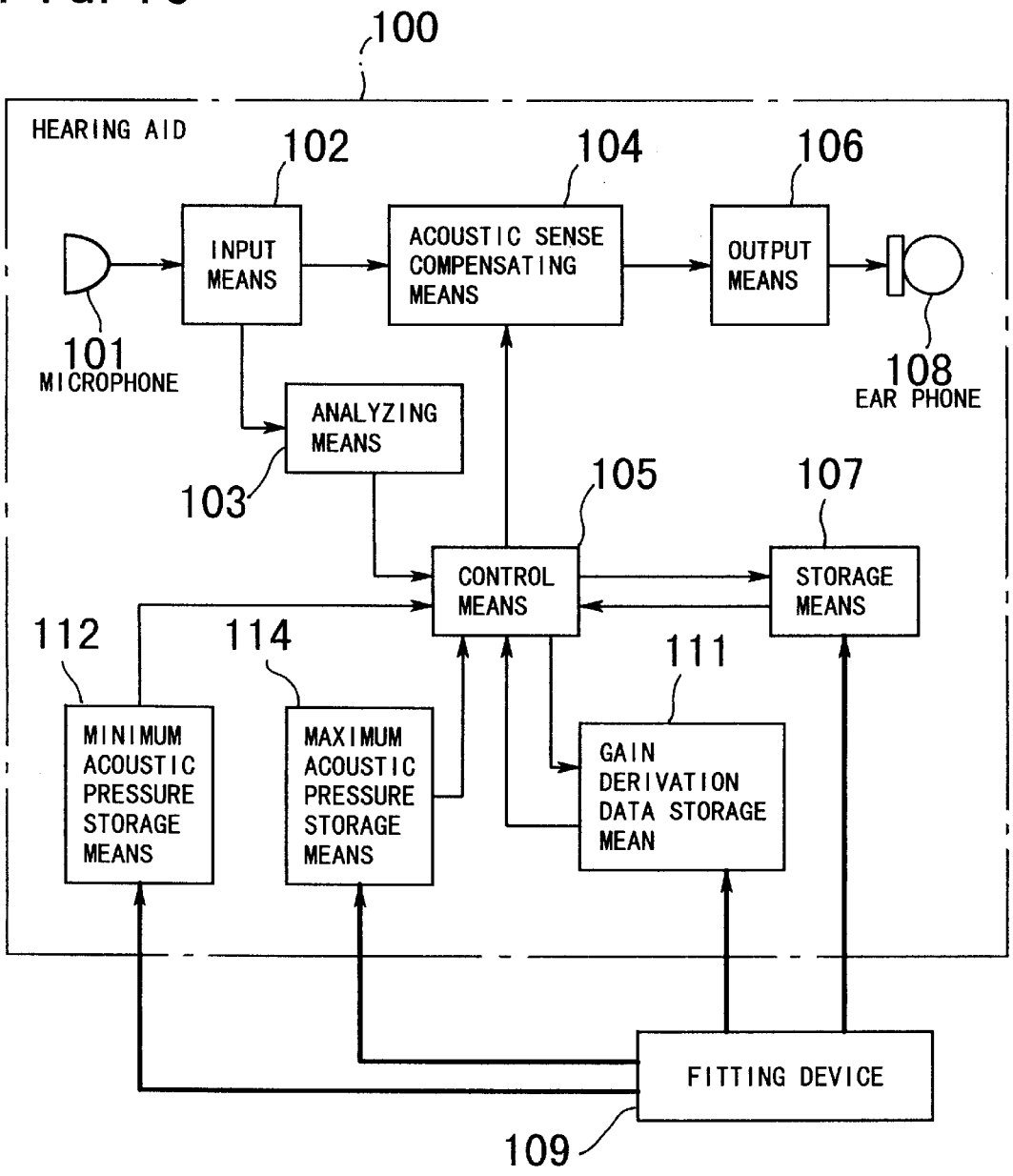
FIG. 10 is a block diagram of the sixth embodiment of the digital hearing aid according to the present invention.

FIG. 10 shows the sixth embodiment of the digital hearing aid according to the present invention. In the sixth embodiment, in addition to the first embodiment of the digital hearing aid according to the invention, a minimum acoustic pressure storage means 112 storing a minimum acoustic pressure level for restricting output in the hearing aid 100, and a maximum acoustic pressure storage means 114 storing the maximum acoustic pressure level for restricting output in the hearing aid 100, are provided. Thus, the input sound having acoustic pressure lower than the preliminarily set minimum acoustic pressure S or higher than the preliminarily set the maximum acoustic pressure L is not output.

Namely, in FIG. 10, the minimum acoustic pressure level and the maximum acoustic pressure level for restricting output in the hearing aid 100 is preliminarily stored in the minimum acoustic pressure storage means 112 and the maximum acoustic pressure storage means 114 from the fitting device 109. The control means reads out the data of the acoustic pressure range the easiest for the user, stored in the storage means 107, and, in conjunction therewith, reads out the maximum acoustic pressure level and the maximum acoustic pressure level stored in the minimum acoustic pressure storage means 112 and the maximum acoustic pressure storage means 114. When the result of calculation of the analyzing means 103 is lower than the minimum acoustic pressure level stored in the minimum acoustic pressure level storage means 112 or higher than the maximum acoustic pressure level stored in the maximum acoustic pressure storage means 114, the control means 105 disables outputting of the input data from the acoustic sense compensating means 104.

Figure 11:
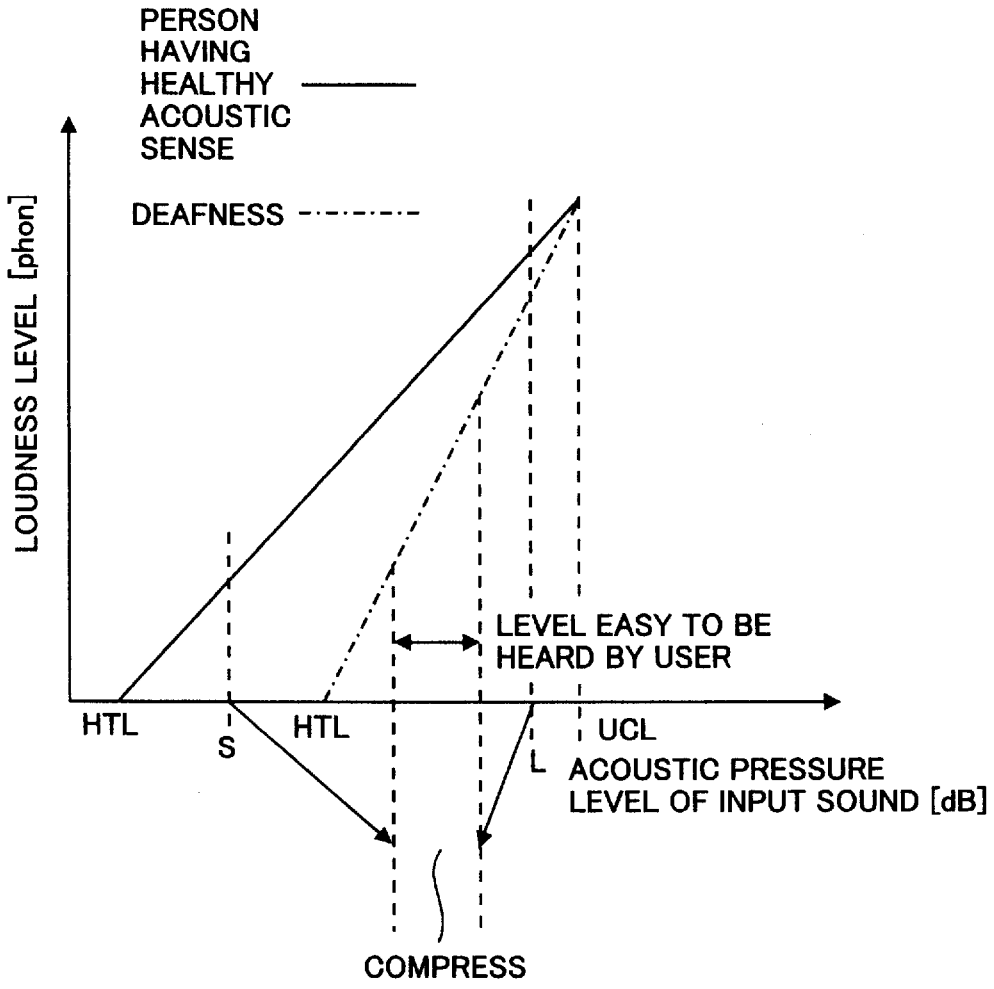
FIG. 11 is a graph showing a loudness curve of the sixth embodiment of the digital hearing aid according to the invention.

On the other hand, the analysis result is higher than or equal to the minimum acoustic pressure level and lower than or equal to the maximum acoustic pressure level, the input data is processed by hearing aid process by the acoustic pressure compensating means 104 using the gain calculated from the data of the acoustic pressure range the easiest for the deafness. As a result, the dynamic range of the input sound becomes a range between the set minimum acoustic pressure level S and the set maximum acoustic pressure L, as shown in FIG. 11 so that the input sound of the acoustic pressure level lower than the set minimum acoustic pressure level S or higher than the maximum acoustic pressure level L is not output from the hearing aid 100.

Figure 12:
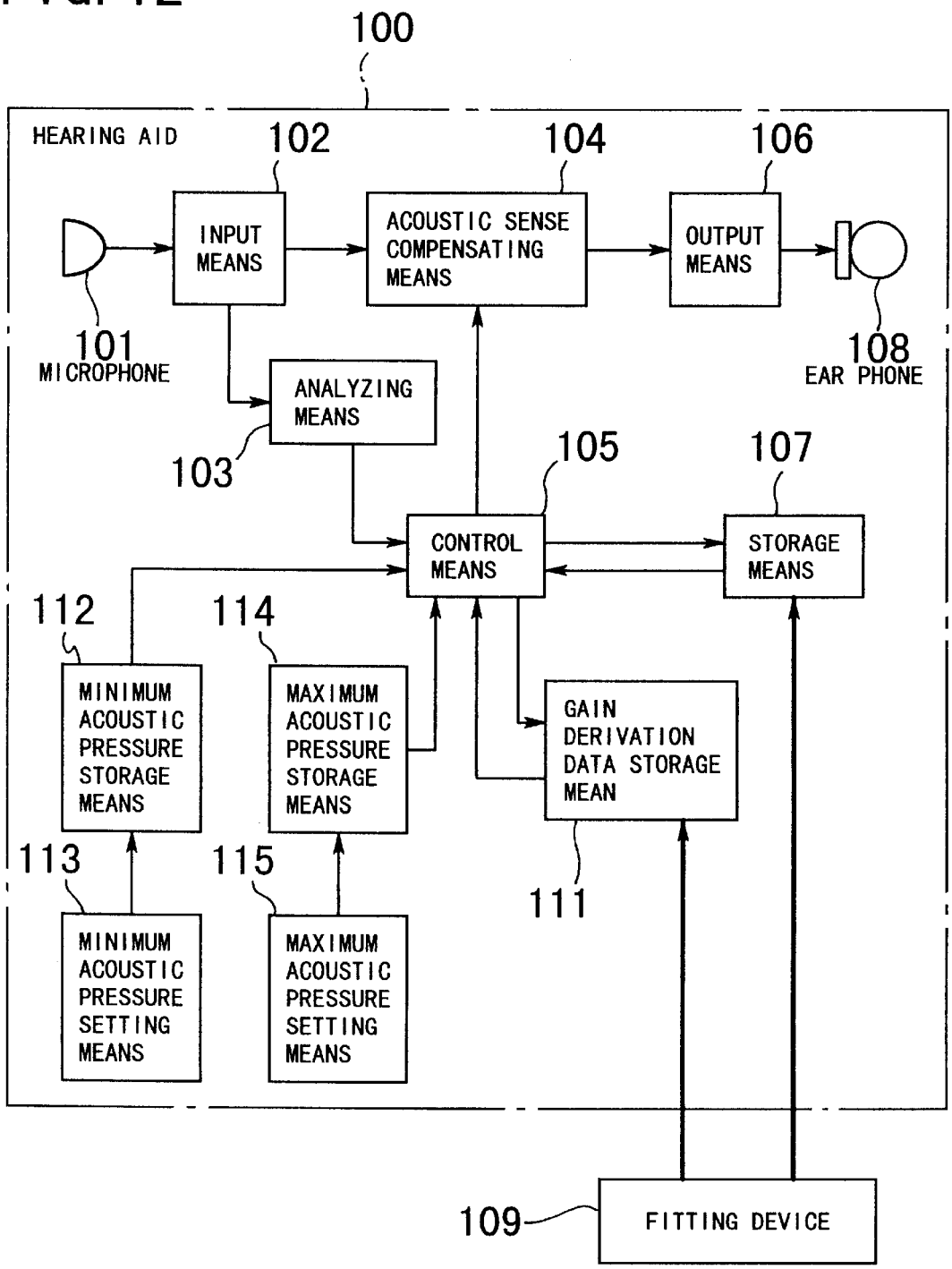
FIG. 12 is a block diagram of the seventh embodiment of the digital hearing aid according to the present invention.
Figure 13:
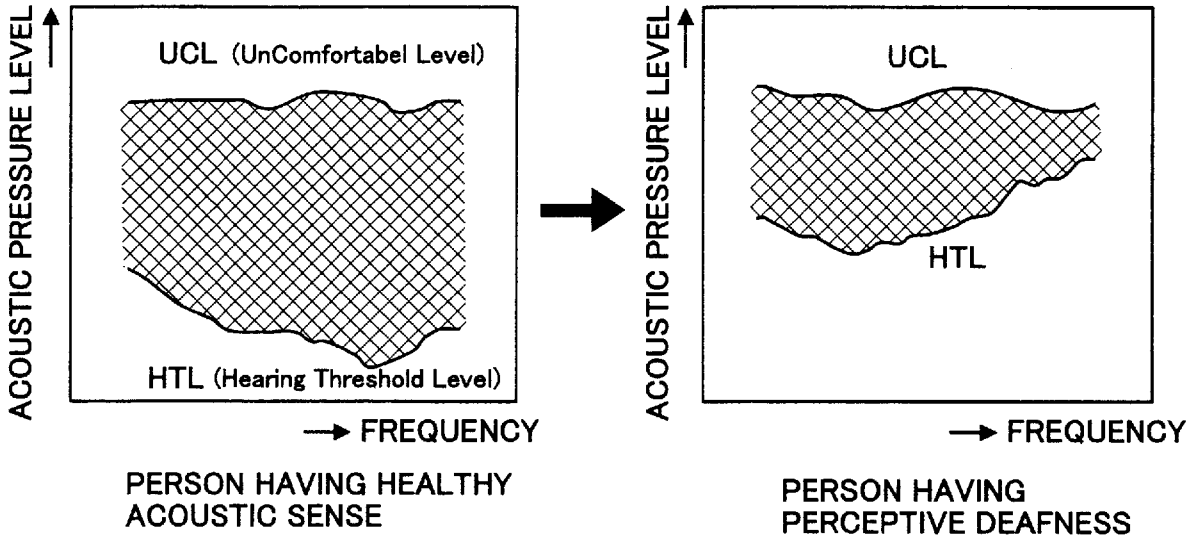
FIG. 13 PRIOR ART
Fig. 13 is an imaginary illustration for explaining sensorineural deafness.
Figure 14A:
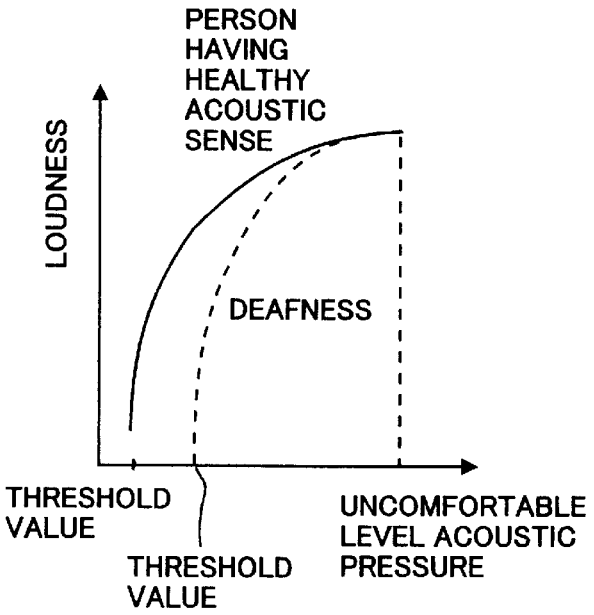
FIG. 14(a) PRIOR ART
FIG. 14 is graphs showing an acoustic sense compensation processing method of a hearing aid in the first prior art.
Figure 14B:
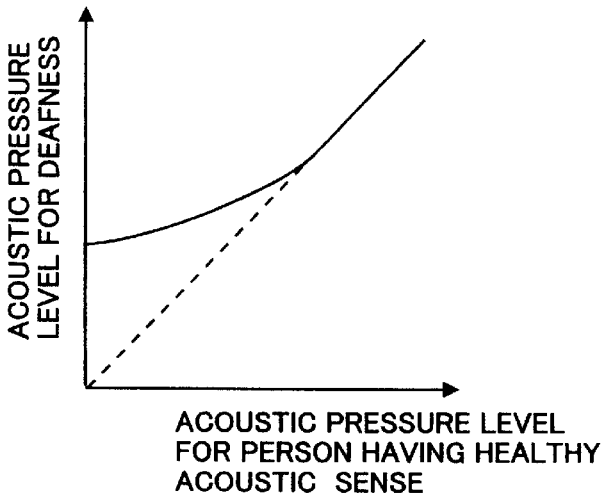
FIG. 14(b) PRIOR ART
Figure 14C:
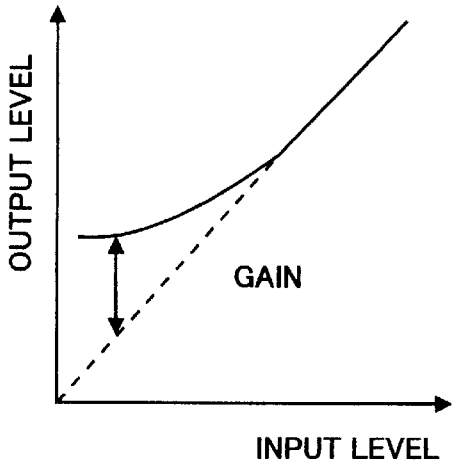
FIG. 14(c) PRIOR ART
Figure 14D:
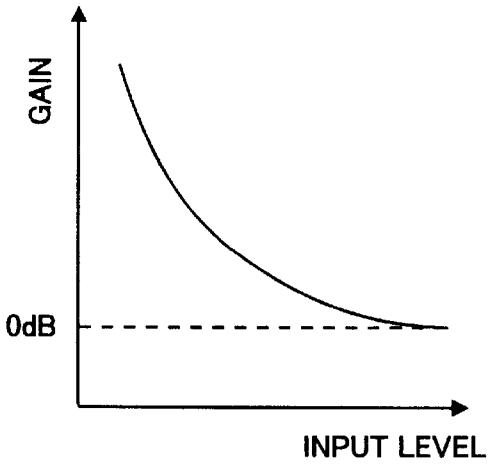
FIG. 14(d) PRIOR ART
Figure 14E:
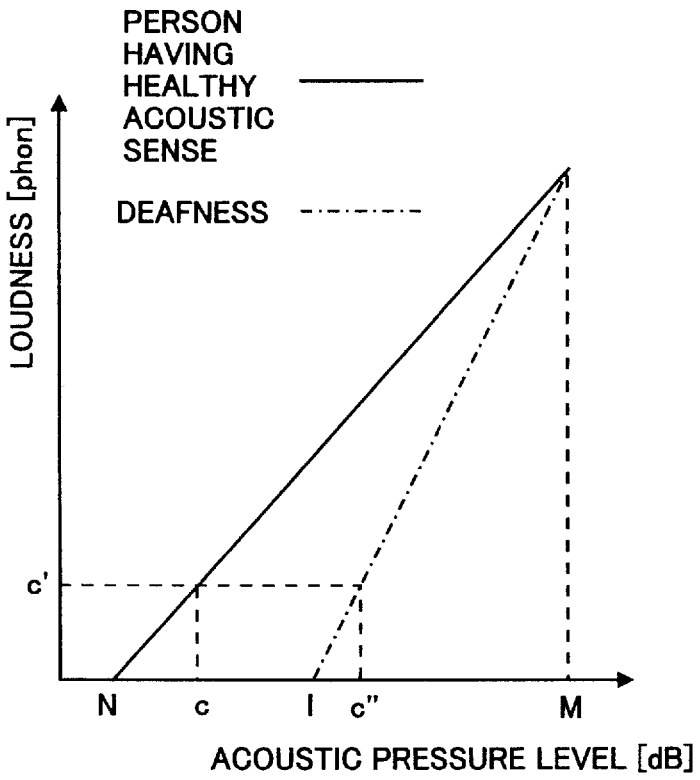
FIG. 14(e) PRIOR ART
Figure 15:
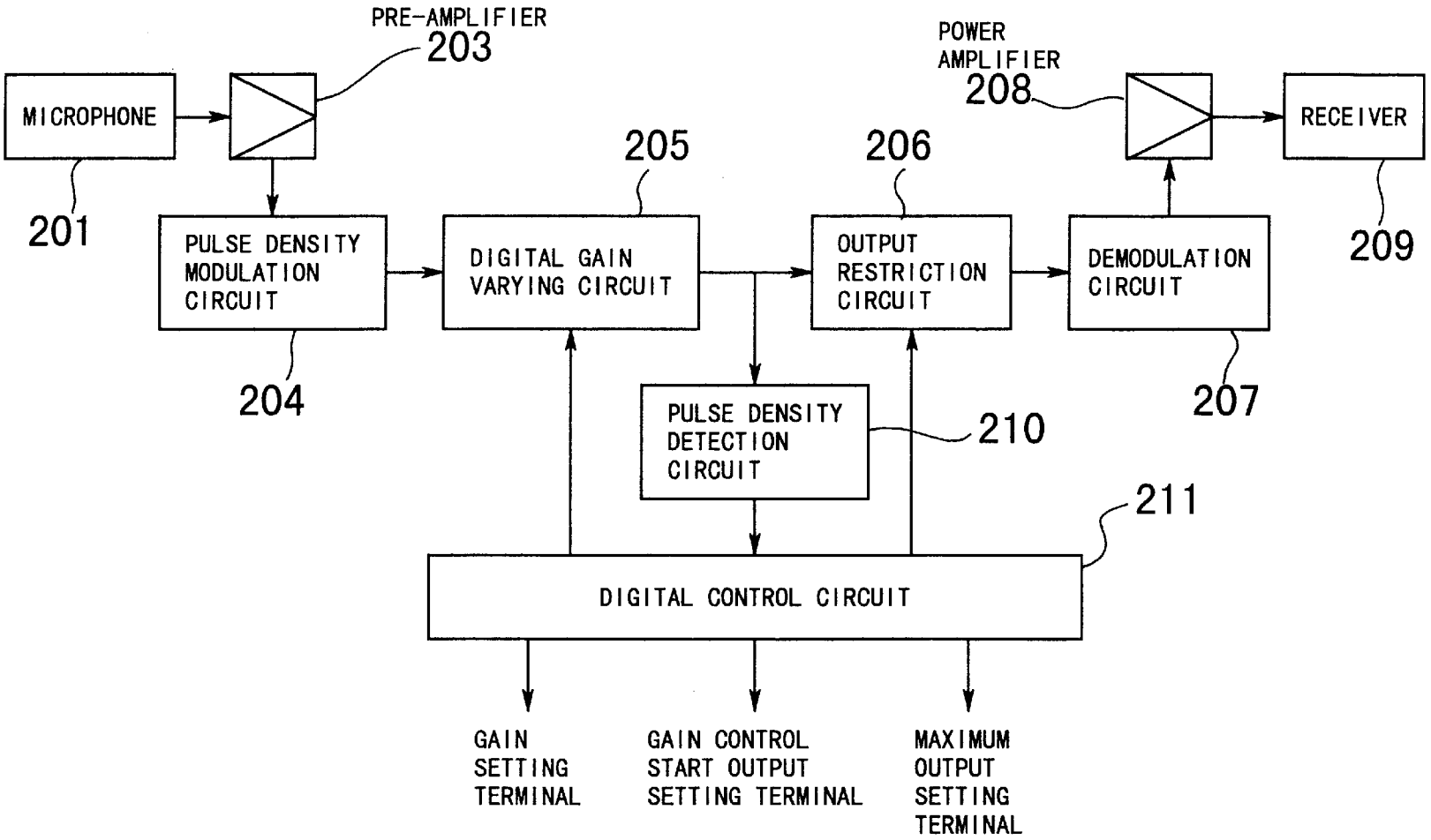
FIG. 15 PRIOR ART
FIG. 15 is block diagram of the second prior art of the digital hearing aid.

FIG. 12 shows the seventh embodiment of the hearing aid according to the present invention. In the seventh embodiment, the minimum acoustic pressure storage means 112 and the maximum acoustic pressure storage means 114 is not set the minimum acoustic pressure level and the maximum acoustic pressure level from the fitting device 109, and instead, are set the minimum acoustic pressure level and the maximum acoustic pressure level by the user through the minimum acoustic pressure setting means 113 and the maximum acoustic pressure setting means 115.

With the first embodiment of the present invention, the dynamic range of the input sound within a range between HTL and UCL of the person having healthy acoustic sense can be compressed into the acoustic pressure range the easiest to hear for the deafness. Therefore, even for the deafness having narrowed acoustic field in comparison with that of the person having healthy acoustic sense, the sound which can be heard by the person having healthy acoustic sense, may be heard. Also, by calculating the acoustic pressure range the easiest to hear for the deafness on the basis of the articulation score test, setting closer to actual environment becomes possible.

With the second embodiment of the present invention, in addition to the first embodiment, an amount of arithmetic operation can be reduced since fine input sound is not output. Also, since the sound having lower than the preliminarily set acoustic level is not output, the deafness may not be troubled by fine sound.

With the third embodiment, in addition to the effect achieved by the first and second embodiments, the minimum acoustic pressure level for restricting the output can be set by the user, only input sound higher than or equal to the acoustic pressure level desired to hear can be listened even under environmental noise.

With the fourth embodiment of the present invention, in addition to the first embodiment, an amount of arithmetic operation can be reduced since excessive input sound is not output. Also, since the sound having higher than the preliminarily set acoustic level is not output, the deafness may not be troubled by excessively loud sound.

With the sixth embodiment, in addition to the effect achieved by the first and fourth embodiments, the maximum acoustic pressure level for restricting the output can be set by the user, only input sound lower than or equal to the acoustic pressure level desired to hear can be listened even under environmental noise.

With the seventh embodiment of the present invention, in addition to the first embodiment, an amount of arithmetic operation can be reduced since fine input sound and the excessively loud sound is not output. Also, since the sound having lower than and higher than the preliminarily set acoustic levels is not output, the deafness may not be troubled by fine and excessively loud sound.

With the eighth embodiment, in addition to the effect achieved by the first and sixth embodiments, the minimum acoustic pressure level and the maximum acoustic pressure level for restricting the output can be set by the user, only input sound lower than and higher than or equal to the acoustic pressure levels desired to hear can be listened even under environmental noise.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A digital hearing aid comprising:

input means for converting an input sound into a digital data for generating an input data;

analyzing means for analyzing said input data converted by said input means by a digital conversion and calculating an acoustic pressure at each frequency band;

control means for inputting a result of calculation by said analyzing means;

acoustic sense characteristics storage means for preliminarily storing acoustic sense characteristics of a deafness and a person having healthy acoustic sense from a fitting means;

gain calculation data storage means for preliminarily storing an acoustic pressure range the easiest to hear for the deafness from said fitting means;

acoustic sense compensating means for performing acoustic sense compensation process by amplifying said input data with a given gain;

said control means calculating said gain of each frequency range on the basis of the acoustic sense characteristics and an acoustic pressure range stored in said acoustic sense characteristics storage means and said gain calculation data storage means.

2. A digital hearing aid as set forth in claim 1, which further comprises minimum acoustic pressure storage means for preliminarily storing a minimum acoustic pressure level from a fitting device, and said control means disables said acoustic sense compensating means to output said input data when the result of said analyzing means is lower than said minimum acoustic pressure level stored in said minimum acoustic pressure storage means.

3. A digital hearing aid as set forth in claim 1, which further comprises minimum acoustic pressure setting means for setting a minimum acoustic pressure by a user, and minimum acoustic pressure storage means for storing the set minimum acoustic pressure level, and said control means disables said acoustic sense compensating means to output said input data when the result of said analyzing means is lower than said minimum acoustic pressure level stored in said minimum acoustic pressure storage means.

4. A digital hearing aid as set forth in claim 1, which further comprises maximum acoustic pressure storage means for preliminarily storing a maximum acoustic pressure level from a fitting device, and said control means disables said acoustic sense compensating means to output said input data when the result of said analyzing means is higher than said maximum acoustic pressure level stored in said maximum acoustic pressure storage means.

5. A digital hearing aid as set forth in claim 1, which further comprises maximum acoustic pressure setting means for setting a maximum acoustic pressure by a user, and maximum acoustic pressure storage means for storing the set maximum acoustic pressure level, and said control means disables said acoustic sense compensating means to output said input data when the result of said analyzing means is higher than said maximum acoustic pressure level stored in said maximum acoustic pressure storage means.

6. A digital hearing aid as set forth in claim 1, which further comprises minimum acoustic pressure storage means for preliminarily storing a minimum acoustic pressure level and maximum acoustic pressure storage means for preliminarily storing a maximum acoustic pressure level from a fitting device, and said control means disables said acoustic sense compensating means to output said input data when the result of said analyzing means is lower than said minimum acoustic pressure level stored in said minimum acoustic pressure storage means or when the result of said analyzing means is higher than said maximum acoustic pressure level stored in said maximum acoustic pressure storage means.

7. A digital hearing aid as set forth in claim 1, which further comprises minimum acoustic pressure setting means for setting a minimum acoustic pressure and maximum acoustic pressure setting means for setting a maximum acoustic pressure by a user, and minimum acoustic pressure storage means for storing the set minimum acoustic pressure level, and maximum acoustic pressure storage means for preliminarily storing a maximum acoustic pressure level from a fitting device, and said control means disables said acoustic sense compensating means to output said input data when the result of said analyzing means is lower than said minimum acoustic pressure level stored in said minimum acoustic pressure storage means or when the result of said analyzing means is higher than said maximum acoustic pressure level stored in said maximum acoustic pressure storage means.

8. A digital hearing aid as set forth in claim 1, wherein said fitting device calculates the acoustic pressure range the easiest to hear for the deafness on the basis of the result of articulation score test.

* * * * *